United States Patent [19]

Reist

[11] 3,951,399

[45] Apr. 20, 1976

[54] ARTICLE-HANDLING APPARATUS

[75] Inventor: Walter Reist, Hinwil, Switzerland

[73] Assignee: Ferag AG, Hinwil, Switzerland

[22] Filed: Oct. 8, 1974

[21] Appl. No.: 513,175

[30] Foreign Application Priority Data

Oct. 10, 1973 Switzerland ..... 14405/73

[52] U.S. Cl. ..... 270/58; 270/60; 271/173

[51] Int. Cl.[2] ..... B65H 39/065

[58] Field of Search ..... 270/58, 60, 54, 55; 198/209, 215; 271/172, 173

[56] References Cited

UNITED STATES PATENTS

| | | | |
|---|---|---|---|
| 1,165,757 | 12/1915 | Cook | 198/215 X |
| 2,461,573 | 2/1949 | Schweizer | 270/55 |
| 2,876,008 | 3/1959 | Mestre | 270/58 |

*Primary Examiner*—Edgar S. Burr
*Assistant Examiner*—A. Heinz
*Attorney, Agent, or Firm*—Cushman, Darby & Cushman

[57] ABSTRACT

Apparatus for handling articles, e.g. newspapers or magazines, having a rotatable member divided into a number of axially-adjacent units. Each unit is divided into a number of radially-extending compartments having feeding devices for transferring articles fed to the compartments of one unit to the compartments of the adjacent unit where additional articles, e.g. inserts, may be added.

18 Claims, 25 Drawing Figures

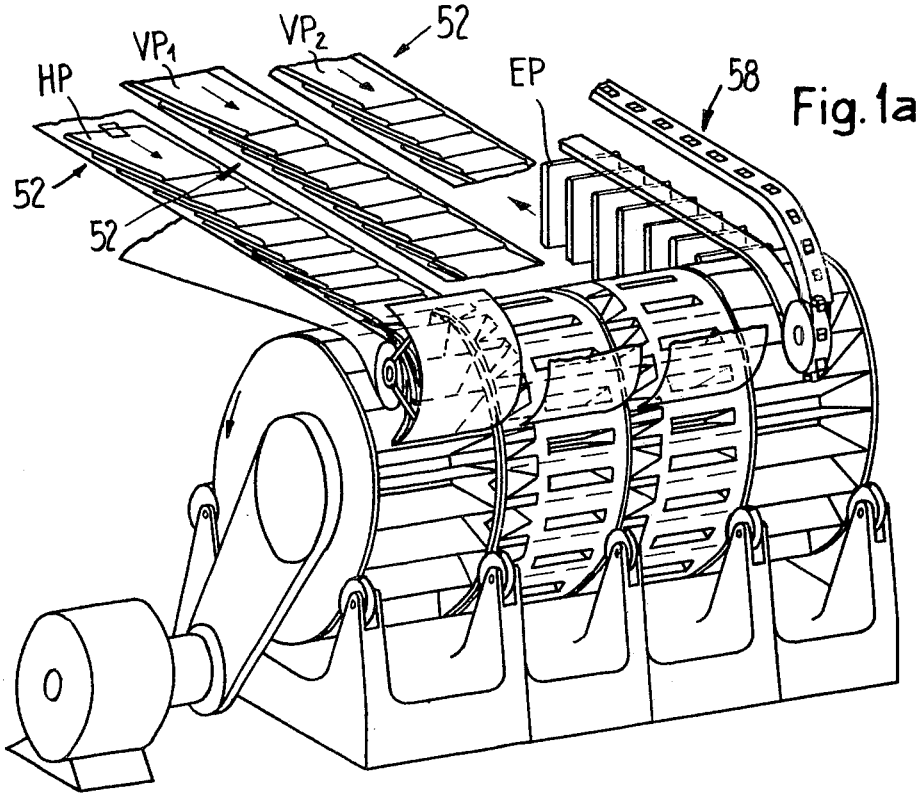
Fig. 1a
Fig. 2a
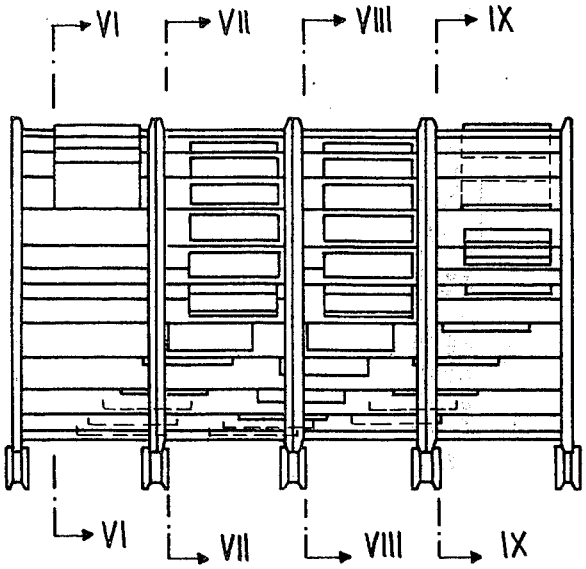

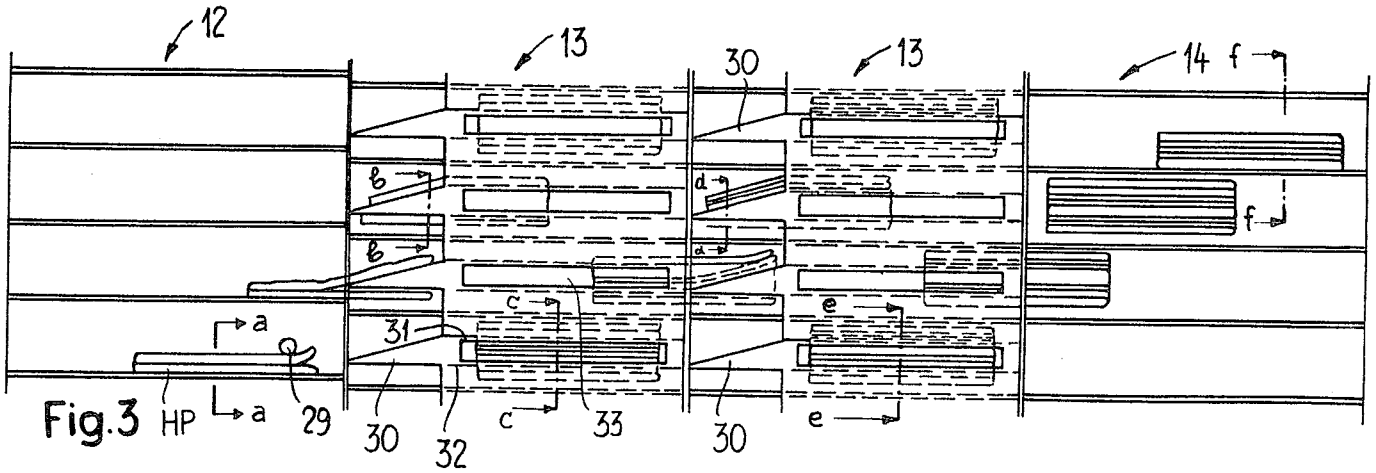
Fig. 3
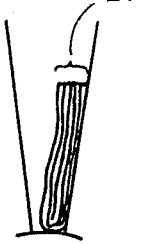
Fig. 4a
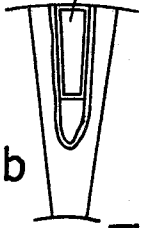
Fig. 4b
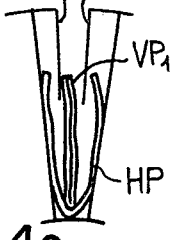
Fig. 4c
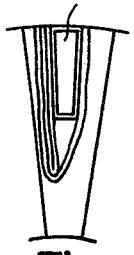
Fig. 4d
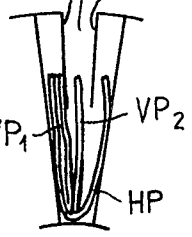
Fig. 4e
Fig. 4f
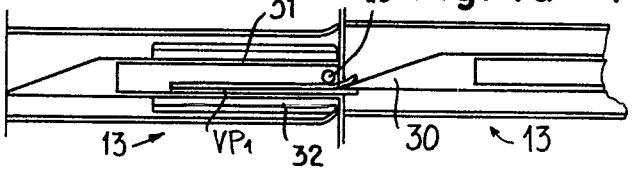
Fig. 5

ARTICLE-HANDLING APPARATUS

BACKGROUND OF THE INVENTION

1. Field of the Invention

The present invention relates to apparatus for handling articles more particularly for the insertion of at least one insert into a folded printed article.

2. Description of the Prior Art

Apparatus for placing inserts into articles, e.g. the magazine section into a newspaper are known in which articles are fed into a drum having radially-extending compartments, and the inserts are introduced during a half-rotation of the drum. This sequence of operation calls for a minimum time, at best in the order of 2 to 3 seconds, in view of the fact that the articles handled in this way are usually relatively sensitive paper products which must be supplied to and delivered from the apparatus.

If the properties of the known apparatus are compared to the production capacity of modern rotary printing machines, capable of delivering copies at the rate of 50,000 and more per hour, it will be seen that the known apparatus would be able to absorb the number of copies supplied by a rotary press only if the wheel has as many compartments and rotates or is driven at a rotational speed which would satisfy the following conditions:

The peripheral velocity (in terms of the number of compartments per second) must correspond to the maximum output of the rotary printing machine;

The time required by a compartment to traverse that part of the rotation of the drum in which the operations required for insertion are performed must not drop below the aforementioned minimum time.

It follows from this that the known apparatus would have to be provided with a drum containing approximately 100 compartments which rotate at a maximum speed of 12 revolutions/minute assuming that handling is at a maximum rate of 20 copies per second with a processing time of 2.5 seconds. These specifications clearly show that the size of the known apparatus would have to be unrealistically increased to gigantic proportions if it is able to process directly the production output from the rotary press.

It has therefore hitherto been the practice to supply the output of a printing machine to several sets of apparatus which in principle operate parallel with each other, this being equivalent to multiplying the apparatus demand and slowing down the products.

SUMMARY

The handling apparatus of the present invention overcomes the above-described disadvantages by providing a drum comprising a plurality of axially-aligned units. Each of the units have radially-extending compartments which are provided with feeding devices for transferring the articles to adjacent units. Inserts or additional articles may then be added as the articles are moved through the adjacent units.

BRIEF DESCRIPTION OF THE DRAWINGS

FIGS. 1 and 1*a* show schematic perspective views of two embodiments of handling apparatus according to the invention, FIGS. 2 and 2*a* show side views of part of the apparatus shown in FIGS. 1 and 1*a*, FIG. 3 is a developed view of the external surface of the rotatable member of FIG. 1.

FIGS. 4*a* to 4*f* are diagrammatic sections along the lines *a—a*, *b—b*, *c—c*, *d—d*, *e—e* and *f—f* of FIG. 3, FIG. 5 is a view similar to that of FIG. 3 showing a section of the drum but in another setting.

DESCRIPTION OF THE PREFERRED EMBODIMENT

Figure 1:
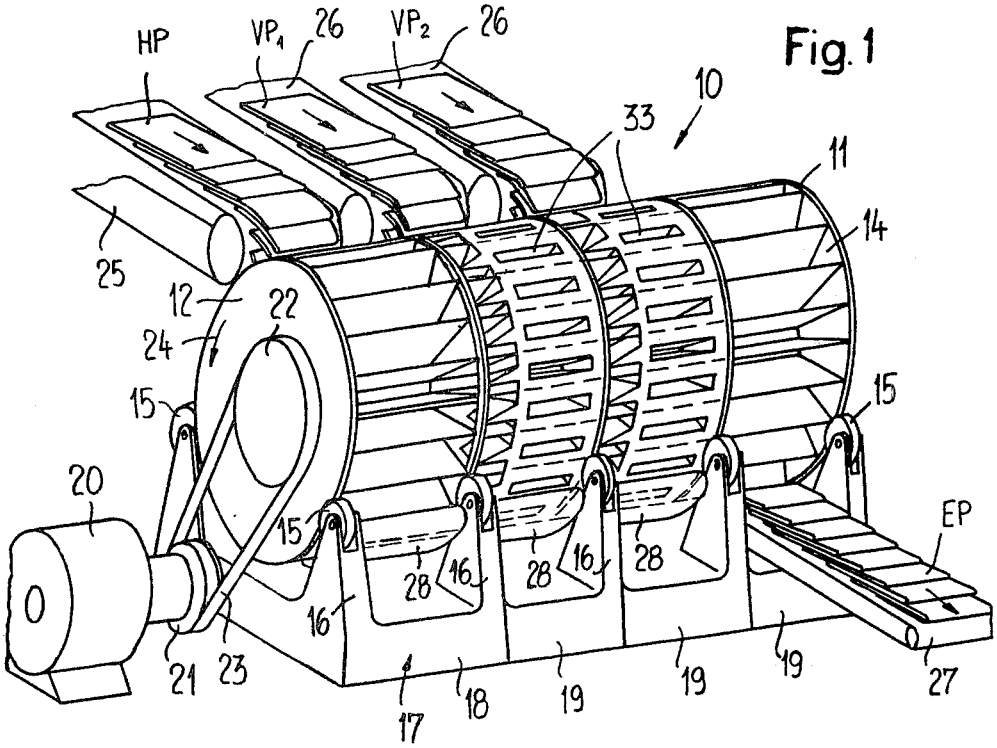
Figure 2:
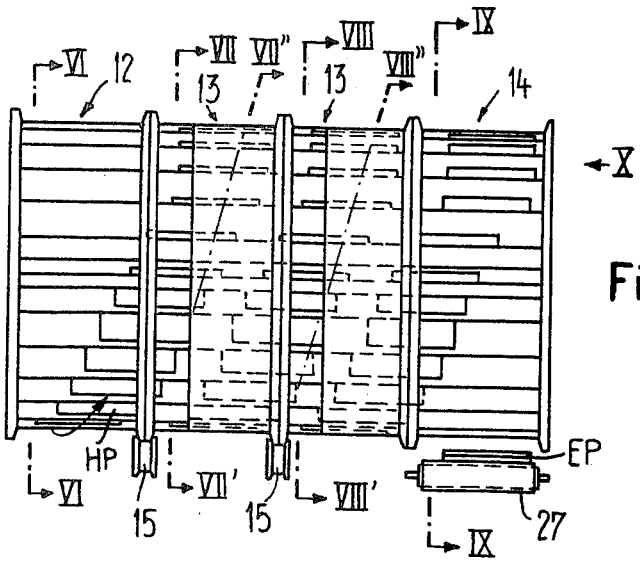

The handling apparatus 10 shown in FIG. 1 comprises an elongate compartmented drum 11, which has a horizontal axis of rotation and is divided into a plurality of wheel units which abut axially upon each other and are fixedly joined to each other. As can be seen in FIGS. 1 and 2 two feed units 13 are arranged between an inlet unit 12 and a delivery unit 14. As will be explained in greater detail with reference to FIG. 11, the units 12 to 14 are detachably joined together by means of annular connecting members so that the units are rotatable together. The annular connecting members also form rails by means of which the drum 11 is freely supported on freely rotatable rollers 15. The rollers 15 are supported by arms 16 extending upwardly from a baseplate 17. The baseplate 17 is divided into abutting support units which are joined to each other, the number of support units being the same as the number of drum units. In FIG. 1 the support unit 18 associated with the inlet unit 12 has four arms 16, while the subsequent support units 19 are formed as so-called attachment support units each of which having two arms 16.

The drum 11 is driven by a geared motor 20 having a drive wheel 21 coupled by means of a chain or a toothed belt 23 to a driving pulley 22, which is fixedly connected to the inlet unit 12. The inlet unit 12 is driven in the direction of the arrow 24.

Supply means, constructed in this case as a conveyor belt 25 and two conveyor belts 26, are associated with the inlet unit 12 and the feed unit 13 respectively for a main article HP and for two inserts $VP_1$ and $VP_2$. The delivery unit 14 is associated with a delivery conveyor shown as a conveyor belt 27 for the end product EP.

As may be seen from FIG. 1, each of the drum units 12 to 14 is divided into a like number of radially-extending compartments which are outwardly open. Dividing walls between adjacent compartments are shown in the interest of simplicity as plane thin plates, but these dividing walls at least partially comprise the feed means associated with each of the compartments, as will be explained subsequently with reference to FIG. 10. Here it is sufficient to note that feed means are provided in each compartment of the drum units 12 to 14 and are able to transfer the contents of the compartment axially in the direction of the axially-succeeding compartments.

This is shown particularly clearly in FIG. 2, which illustrates the relative position of the contents of the compartments in relation to the rotational position of the drum 11. FIG. 1 also shows that the peripheral surface of the drum 11 nearest to the baseplate is covered in sections by an endlessly co-rotating belt 28 so that the contents of the compartments are prevented from the dropping out when the compartments face the baseplate 17 as the drum 11 rotates.

As may be seen from FIGS. 1 and 3, the compartments of the inlet unit 12 are similar to those of the delivery unit 14, and the compartments of the two feed supply units 13 are of similar construction. The compartments in the inlet unit 12 and the delivery unit 14 are defined by side walls which also contain feed means although they are shown as plates in FIGS. 1 and 3. One example of such feed means will be described with reference to FIG. 10. Each of the units 12 to 14 also contain a thrust member 29 (shown merely as a circle in one of the compartments of the unit 12 in FIG. 3). The thrust member 29 is adapted to reciprocate in a controlled manner in the compartment from one side wall to the other for the purpose of pushing the contents of the compartment against the feed means. Embodiments of the thrust members 29 will also be described later with reference to FIG. 10.

Each of the compartments of both supply units 13 contain barriers or obstacles in the form of a wedge 30 tapering outwardly in the feed direction, i.e. from left to right in FIG. 3. The tapering surfaces of the wedge 30 adjoin two guide plates 31 and 32 which extend radially inwards into the respective compartment (see also FIG. 4*c*) and define a slot 33 between them for receiving one of the inserts $VP_1$ or $VP_2$. In the embodiment shown in FIG. 3 the wedge of each wedge in the compartments of the right-hand supply unit 13 directly adjoins the end of the corresponding guide plate 32 in the compartments of the preceding left-hand supply unit 13. As already mentioned, the units 12, 13 and 14 are fixedly joined to each other, but their relative rotational position is adjustable, as indicated for example at the position where the compartment of unit 12 merges into the first compartment of unit 13 in FIG. 3.

Figure 10:
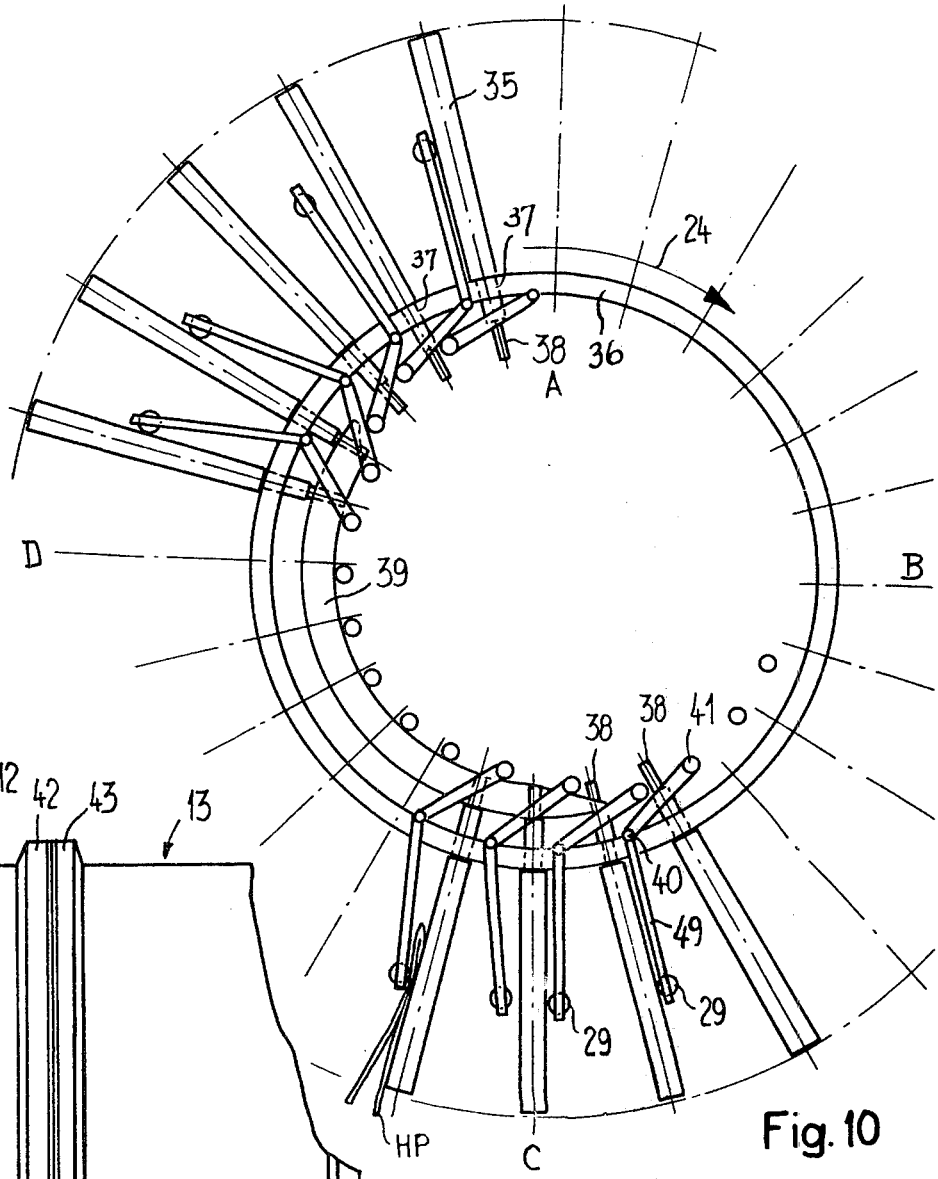
FIG. 10 is a diagrammatic section through one of the units of the drum as seen in the direction of the arrow X of FIG. 2.

As already mentioned, feed means as well as at least one thrust member 29 are associated with each of the compartments of the units 12 to 14. One embodiment of the feed means and the thrust member 29 will be described with reference to FIG. 10, which shows a diagrammatic section through the inlet unit 12 or through the delivery unit 14, but only as seen in the direction of the arrow X of FIG. 2. In FIG. 10 roller tracks are shown in the region of the separating walls between adjacent compartments and comprise radially-extending rollers 35 which are freely rotatably supported at 37 in a tubular core 36 of the drum 11. Each of the rollers 35 is provided with a shaft stub 38 which extends into the interior of the core 36. Only one roller 35 of the roller track is shown in FIG. 10 because the roller tracks extend perpendicularly to the plane of the drawing. The shaft stubs 38 of the rollers of all roller tracks disposed at a given height of the wheel axis 11 therefore form a kind of pin ring with inwardly orientated, freely rotatable pins. In the course of one rotation the pin ring runs on one side cheek of a slotted link or stationary cam 39 which extends over the sector (end of the quadrant BC, quadrant CD and beginning of the quadrant DA) in which the feed means are to be driven. Frictional engagement between the shaft stubs 38 constituting cam followers and the side cheek of the slotted link or cam 39 thus causes the rollers in the aforementioned sector to be driven so that the leading track surface of the roller tracks in FIG. 10 rotates to convey an article out of the plane of the drawing. The presence of a roller track with intermittently driven rollers itself is insufficient to ensure reliable and positive transfer of the contents of the compartments. To this end each compartment is associated with the thrust member 29 which is a spherical roller in the embodiment illustrated in FIG. 10. The thrust member 29 is supported so as to be freely rotatable at one end of a rocker lever 49 which in turn is connected to a trunnion 40 which extends parallel to the axis of the drum 11. The other end of the rocker lever 49, which extends to the interior of the core 36, supports a roller 41 which is freely rotatable and whose axis is parallel to that of the trunnion 40. The rocker lever 4 is biassed by means of a spring (not shown) into the position which is shown at the bottom right of FIG. 10. In the course of rotation of the drum 11 the roller 41 moves onto the radially-inner edge of the slotted link 39 and causes the rocker lever 49 to perform a pivoting motion against the bias in an anti-clockwise direction, so that the spherical thrust member 29 moves from one side wall of the compartment to the other side wall as shown at the bottom of FIG. 10. This causes the contents of the compartment to be thrust against the roller track (as shown in the 2nd compartment of quadrant CD), so that the contents are advanced in the direction out of the plane of the drawing if the roller track is driven. As soon as the roller 41 drops off the inner edge of the slotted link 39, the thrust member 29 again moves back to the other side wall from left to right as shown in quadrant DA of FIG. 10.

Figure 11:
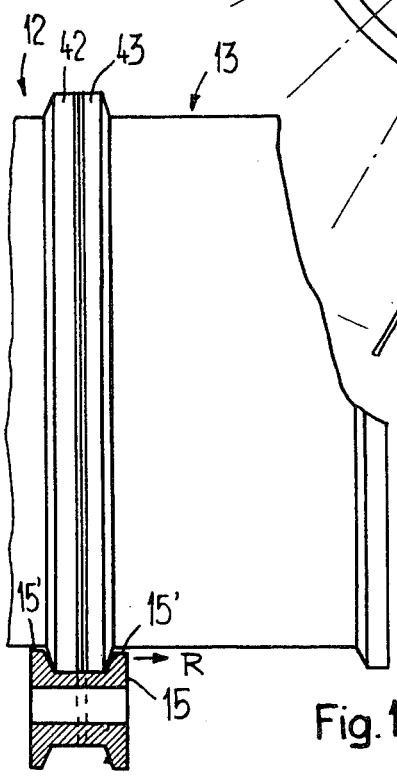
FIG. 11 is a detail of part of the drum illustrating the connection between two adjacent units.

FIG. 11 shows how adjacent units 12 and 13 of the drum 11 are joined together by annular connecting members in the form of threaded rings 42, 43. The rings 42, 43 are screwmounted to each other and their external surface forms a circular rail which engages in the track between track rings 15' and 15'' of the rollers 15 (see also FIG. 1). On releasing the rings 42, 43 the relative annular position of adjacent units can be adjusted easily. The second supply unit 13 is connected in a similar way to the first supply unit 13 and the delivery unit 14. Furthermore, the drum 11 is easy dismantlable to remove one or more units for repair or maintenance purposes. The removal of one or more of the units also allows ready access to the interior of the tubular core 36 of the drum 11. The construction of the drum 11 as well as of the baseplate 17 from component units enables the entire apparatus to be extended by a plurality of further supply units without the need for modification of the drive.

OPERATION

The operation of the handling apparatus is described with reference to FIGS. 3 and 4*a* to *f*. The main article HP disposed in one compartment of the inlet unit 12 is advanced in the course of rotation of the drum 11 towards the succeeding feed or supply unit 13 and into one of its compartments. Prior to being transferred from the compartment of the inlet unit 12 into the compartment of the supply unit 13 the main article HP is subjected to lateral thrust applied by the thrust member 29 and thus bulges slightly as illustrated in FIG. 4*a* so that a gap is formed in the main article HP into which gap the edge of the wedge 30 is able to penetrate in the succeeding compartment. Since the feed motion is positive the wedge 30 penetrates into the main product HP and opens it as illustrated in FIG. 4*b*, and in the second to top compartment of the supply unit 13 on the left in FIG. 3. The thrust force of the thrust member 29, not shown further in FIG. 3, is then removed and the opened main article drops on to the floor of the compartment in the supply unit 13 but the guide plates 31 and 32 keep the article HP in the open position. At this moment the first insert $VP_1$ is inserted through the slot 33, as illustrated in FIGS. 3 and 4*c*, in such a way that the insert drops into the opened main article HP. The edges of the wedges 30 of the right-hand feed or supply unit 13 in FIG. 3 are aligned with the guide plates 32 of the corresponding compartments of the left-hand supply. Therefore, as the article HP with one insert $VP_1$ moves from the left-hand to the right-hand supply unit 13, the insert $VP_1$ is merely pushed to one side as shown in FIG. 4*d* so that space is provided (FIG. 4*e*) for the insertion of a second insert $VP_2$. The article which has been further advanced and has now become the end product EP is then made available in the delivery unit 14 for delivery, a procedure which will be described with reference to FIG. 9.

FIGS. 3 and 4*a* to *f* illustrate the operation in a time scale which has been greatly speeded up. FIGS. 6 to 9 on the other hand represent diagrammatic instantaneous views of cross-sections of the inlet unit 12, of the two feed or supply units 13 and of the delivery unit 14, the instantaneous position of the contents of the appropriate compartments being shown in dependence on the particular rotational position with respect to the axis of rotation of the drum 11.

FIG. 5 shows that the edge of the wedge 30 can also be arranged midway between the guide plates 31 and 32 of the preceding compartment by appropriate adjustment of the right-hand supply unit 13 relative to the preceding supply unit 13. It is therefore possible for the initially-inserted insert $VP_1$ to be centrally opened on transfer from the first supply unit 13 into the succeeding supply unit 13 so that the insert $VP_2$ is inserted within the insert $VP_1$.

Figure 6:
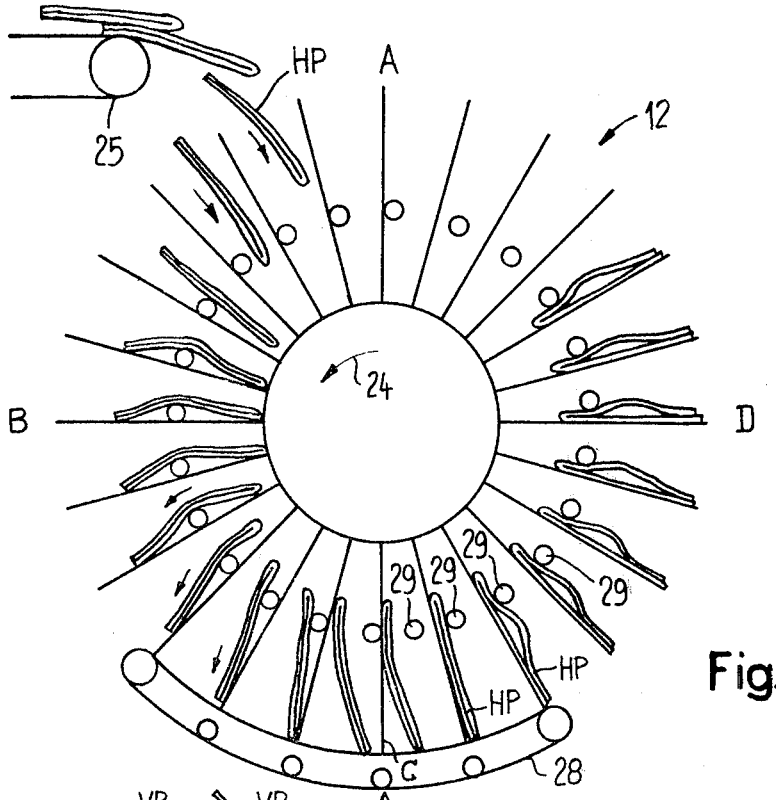
FIGS. 6 to 9 and 6*a* to 9*a* show diagrammatically sections along the lines VI–VI, VII–VII′ – VII″, VIII–VIII′ – VIII″ and IX–IX of FIGS. 2 and 2*a* respectively, the sections along the lines VII–VII′ – VII″ and VIII–VIII′ – VIII″ extending along helical planes which are coaxial to the axis of the rotatable member.

To facilitate understanding FIGS. 6 to 9 four quadrants AB, BC, CD and DA are shown, each of the quadrants containing six compartments. Since each compartment has a different angular position it is also possible to regard FIG. 6 as superimposed images of one compartment in twenty-four different rotational positions. FIG. 6 shows that an article HP supplied by the conveyor 25 is about to drop into the second compartment of the quadrant AB. The article falls into the compartment until the fold arrives at the bottom of the compartment (5th compartment). The fold remains at the bottom of the compartment until the compartment enters the quadrant BC and begins to tip downwardly (2nd compartment in quadrant BC). The article HP then begins to slip radially outwardly until it bears on the part of the belt 28 nearest to the drum 11 (5th compartment in the quadrant BC). The feed device associated with the compartment begins to act in the radial direction on changeover from quadrant BC to quadrant CD and at the same time the thrust member 29 moves from one side of the compartment to the other side to push the article HP against the feed device (2nd compartment in the quadrant CD). The thrust member 29 produces a bulge in the article HP (3rd compartment in the quadrant CD) and since the articles are simultaneously moved axially from the inlet unit 12 to the first supply unit 13, the gap resulting from the bulge moves on to the end of the wedge 30 of the first supply unit 13. The article is fed axially as far as the quadrant DA so that the article is advanced from the compartment of the inlet unit 12 into the axially succeeding compartment of the first supply unit 13. In other words, the compartments of the inlet unit 12 are emptied in the course of traversing through the quadrant DA and at the same time the thrust member 29 returns from its clamping position to the oppositely disposed side wall of the compartment (4th to 6th compartment in quadrant DA and 1st compartment in quadrant AB).

When the article HP is being transferred to a compartment of the axially-adjacent supply unit 13 (FIG. 7, 3rd compartment in quadrant CD) the article moves on to the edge of the wedge 30 as already mentioned, and is opened thereby during axial feed motion. The thrust member then returns into its inoperative position (6th compartment CD and 1st compartment BA, FIG. 7). The article which is now held open by the guide plates 31 and 32 is advanced further by its trailing edge into the appropriate compartment of the supply unit 13 and drops back onto the bottom of the compartment (4th to 6th compartment in quadrant DA, FIG. 7) and then continues its rotation in open V-shape. An insert $VP_1$ is then inserted into the second compartment of the quadrant AB, FIG. 7, so that it is located in the opening of the article HP (2nd to 4th compartment in quadrant AB, FIG. 7). The procedures already described in conjunction with the quadrant BC of FIG. 6 are then basically repeated, the only difference being that they take place in a compartment of a supply unit and therefore apply to first insert $VP_1$ as well as to the article H.

Figure 7:
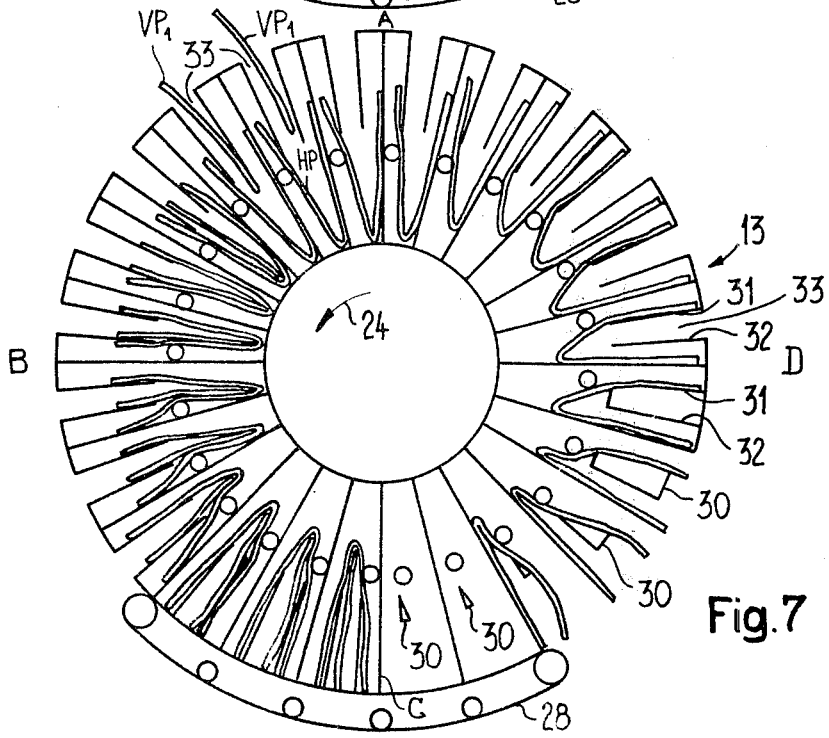
Figure 6A:
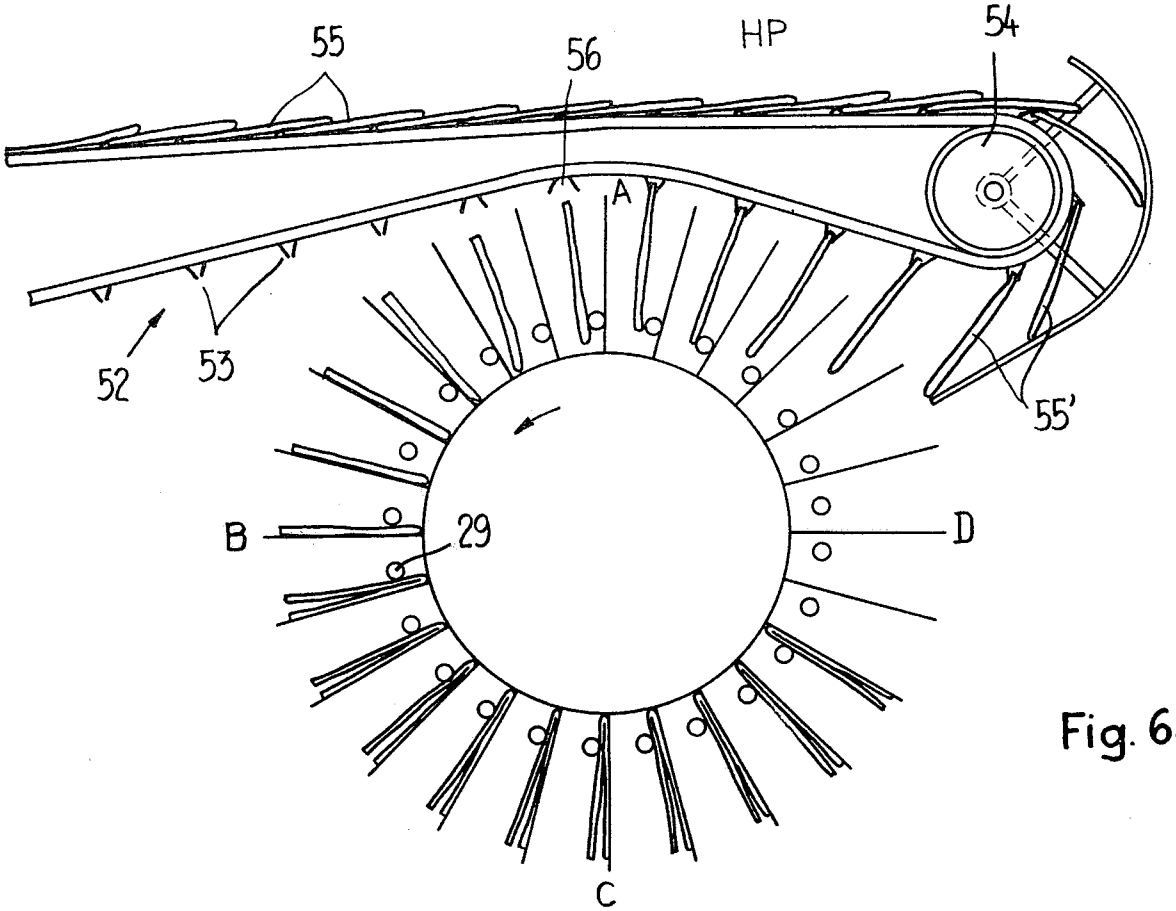
Figure 7A:
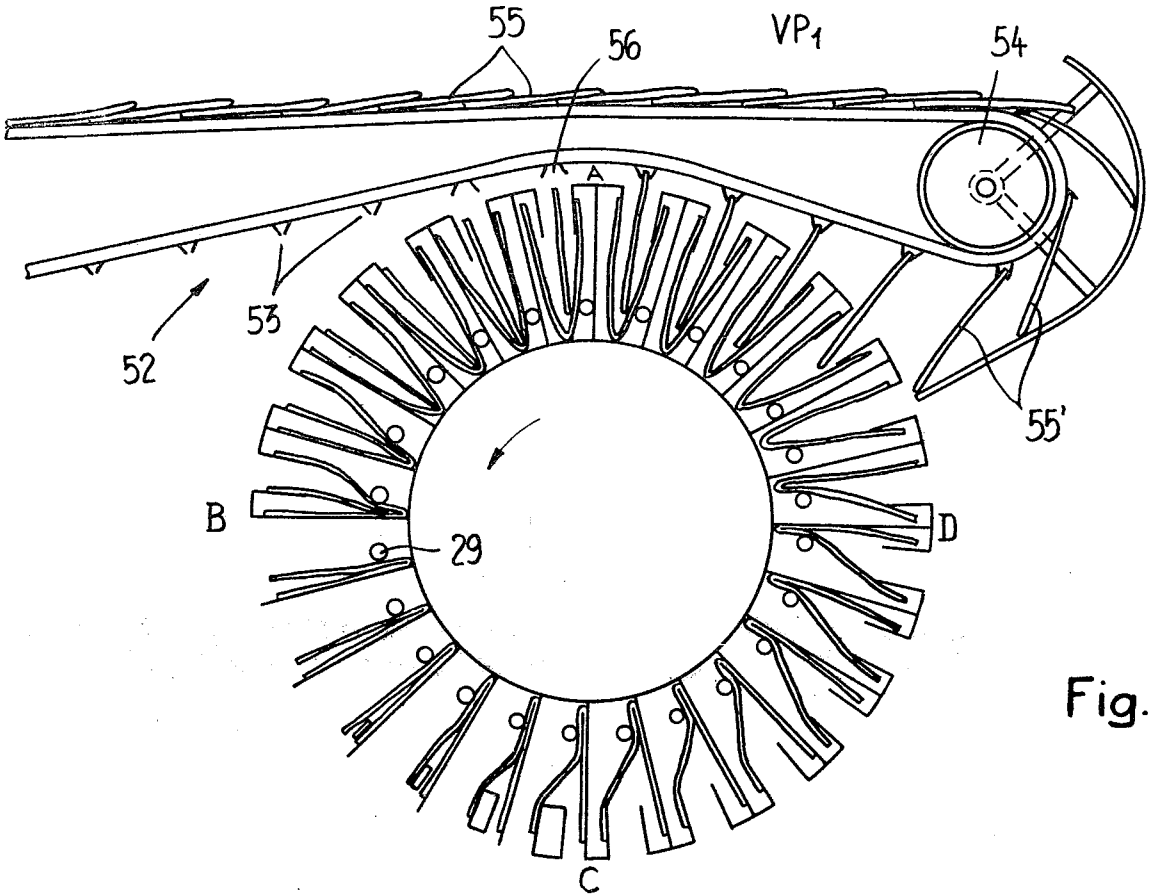
Figure 8:
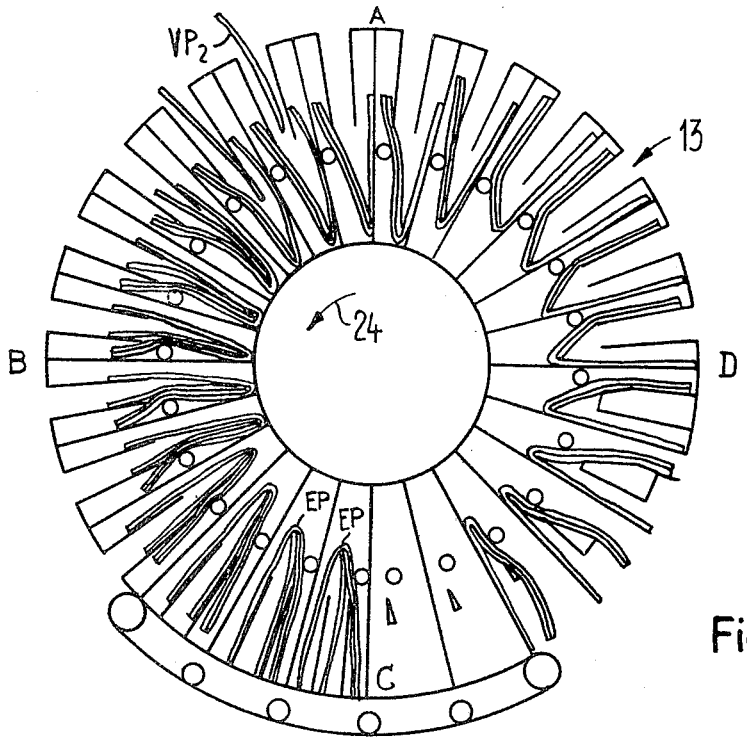
Figure 9:
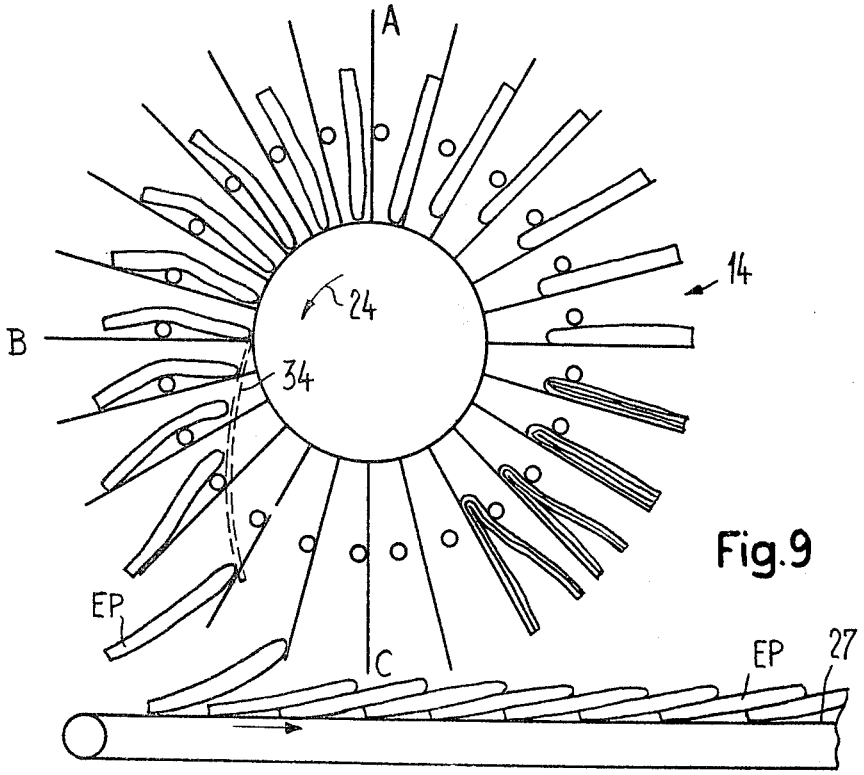
Figure 8A:
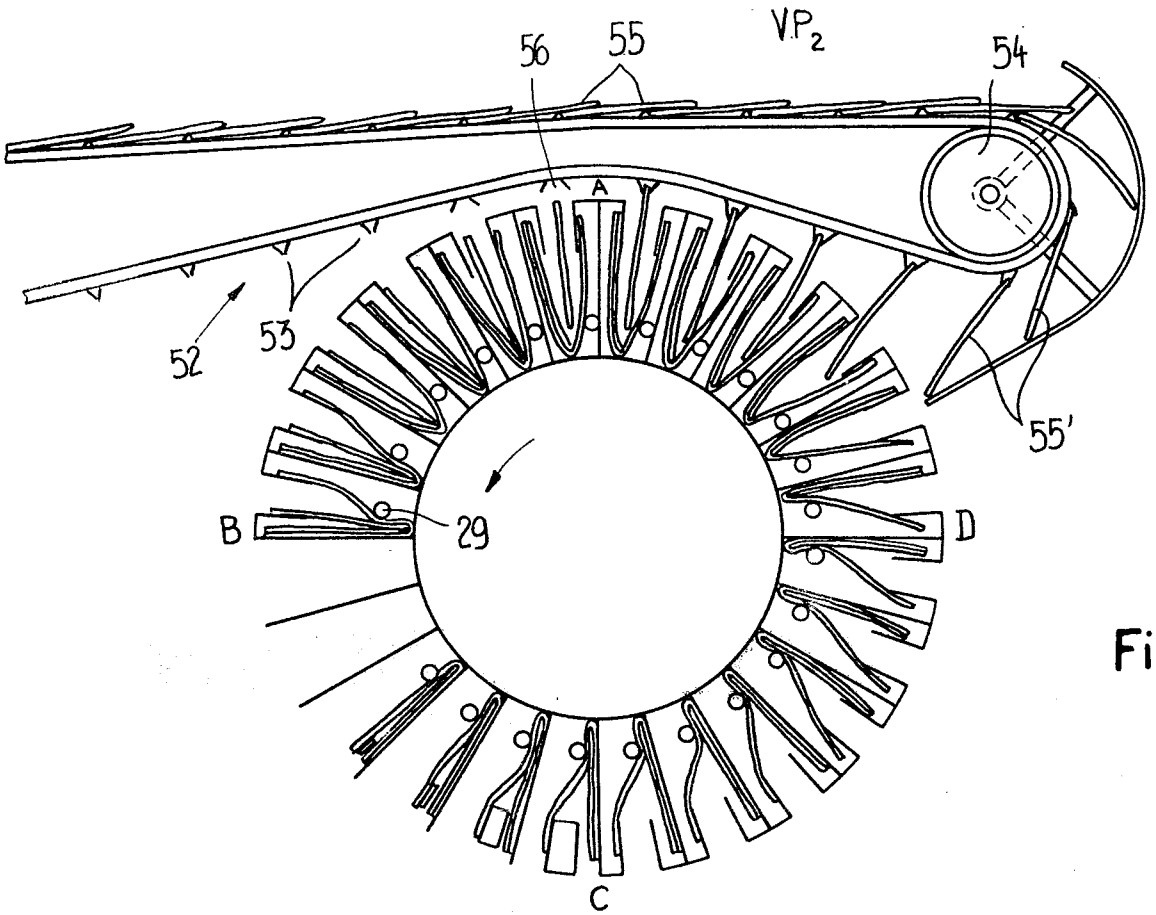

By analogy, the procedures which are illustrated in FIG. 8 correspond to those of FIG. 7 except that in this case a second insert $VP_2$ is added. The end product EP (corresponding to $HP + VP_1 + VP_2$) is practically completed and ready for delivery in the 5th and 6th compartment of the quadrant BC of FIG. 8. To this end, it is initially advanced further into the corresponding compartments of the delivery unit 14 which, in contrast with the compartments in the supply units 13, have no obstacles or barriers. This procedure is illustrated in FIG. 9 (2nd compartment in the quadrant CD to 6th compartment in the quadrant DA of FIG. 9). After a certain settling time the end product EP drops either by its own dead weight or assisted by stationary guide rails 34 (FIG. 9) on to the delivery conveyor 27 which extends away from the delivery unit 14 and is driven from below.

The advantages of the above-described apparatus are evident. Firstly, by arranging the units of the drum 11 in the axial direction the articles travel over a substantially helical path while being processed, i.e. they can be allowed to remain in the drum 11 for several rotations so that the minimum time required for handling can be easily obtained without the need for increasing the diameter of the wheel. The maximum production rate of a modern rotary printing machine can also be absorbed by means of the relatively modest dimensions. As an example it should be mentioned that a production rate if 36,000 copies/hour can be "absorbed" with an external diameter of approximately 1200 mm, a depth of compartments of approximately 350 mm, and 24 compartments at a speed of 25 revolutions/min, approximately 4 to 5 seconds being available for the passage of one copy through the system (from the inlet unit to the delivery unit). The construction of the drum 11 in separate drum units, also permits modular extension of the drum, i.e. the apparatus can be readily adapted to individual requirements and practices by the addition or omission of one or other unit.

MODIFICATIONS

In FIGS. 1*a*, 2*a* and 6*a* – 9*a* reference numerals have been inserted only for parts mentioned subsequently. In order to avoid repetition, the following description is confined merely to differences of construction and operation between this and the previously-described embodiment.

As may be seen in FIG. 1*a*, and more particularly in FIGS. 6*a* to 8*a*, the main article and the inserts are supplied by means of conveyors 52. Each conveyor 52 is provided with spaced jaws 53. The articles 55 which are conveyed in an overlapped formation on the upper stretch of the conveyor, which passes over a reversing pulley 54, are gripped by the gripper jaws along the trailing edge so that when the jaws 53 pass around the reversing pulley 54 into the lower stretch of the conveyor 52 the articles become suspended as indicated at 55'. The bottom stretch of the conveyor 52 extends approximately tangentially to the wheel, the jaws being arranged at distances in accordance with the spacing of the components so that they mesh with the compartments in the manner of a rack and pinion. The downwardly depending articles 55' are thus inserted into the compartments of the wheel and, as illustrated at 56, are released approximately in the region of the top of the wheel by opening of the jaws. This applies to the main articles as well as to the inserts. Proceeding from FIG. 6*a* the articles are then displaced axially while being opened by wedges and in the course of the continued feed motion the first insert and, where appropriate after opening thereof, the second insert is also supplied.

In contrast with the first embodiment the articles in each unit are gripped by the thrust members 29 before the articles leave the quadrant AB and are retained in the quadrants BC and CD so that they cannot drop out. This dispenses with the closure comprising the endless belt 28 in the previous embodiment. No radial reciprocating motion of the articles therefore occurs in this case.

The relationship between FIGS. 2*a* and FIGS. 6*a* to 8*a* is the same as that between FIGS. 2 and 6 to 8. There is merely a phase shift in the sense that the articles are introduced while they are still in the quadrant DA and not only when they reach the quadrant AB. This also applies to the inserts. The procedure remains fundamentally unchanged so that FIG. 2*a* is readily understandable in the light of the description of FIG. 2.

Figure 9A:
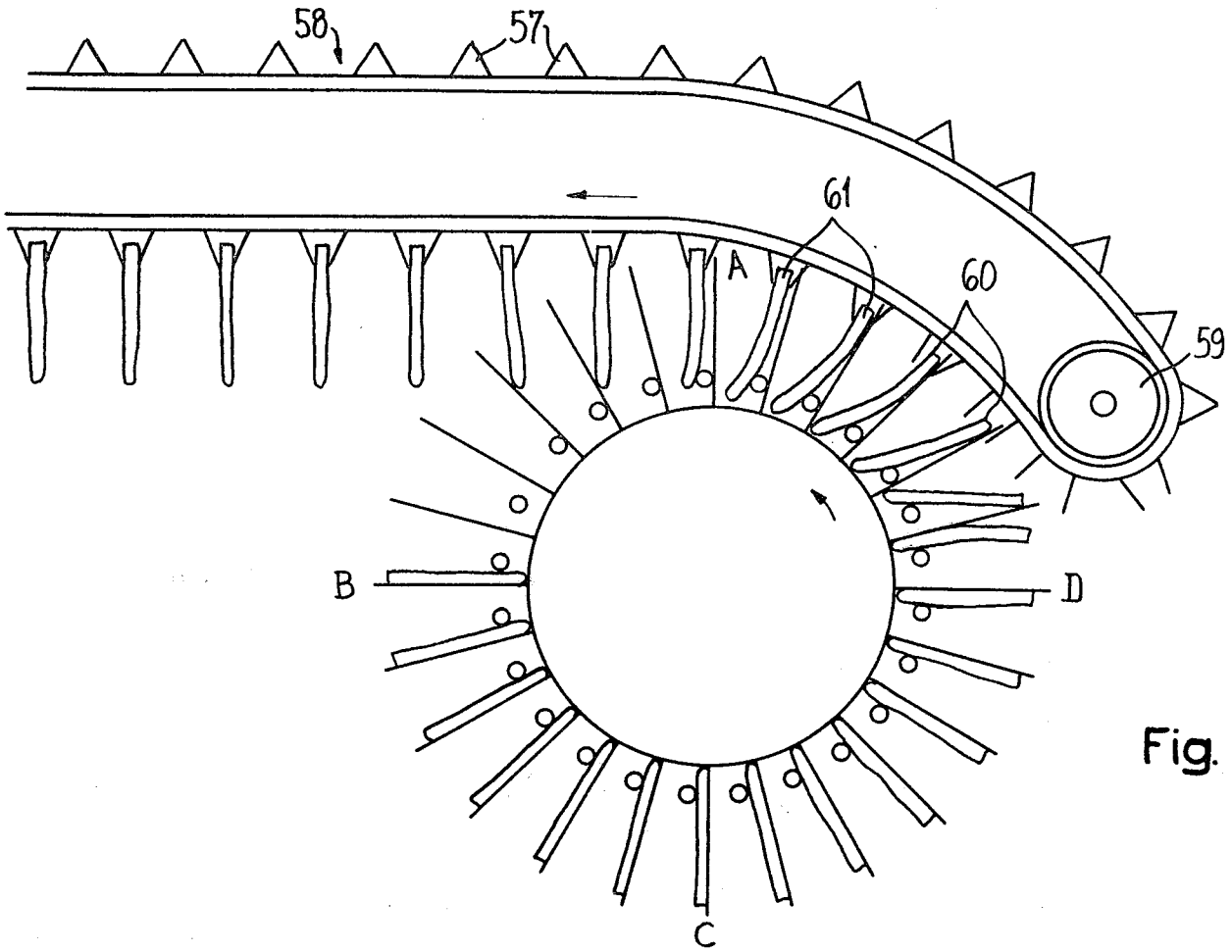

In this embodiment, the end products could also be removed in accordance with the steps disclosed in FIG. 9. However, a conveyor 58 (FIGS. 1*a* and 9*a*) is provided. Like the conveyor 52 the conveyor 58 is also provided with jaws 57 and passes around a reversing pulley 59, so that its bottom stretch passes over the drum in the form of an arc as shown in FIG. 9*a* for removing the end products. In this arrangement the distance between adjacent jaws 57 also corresponds to the spacing of the compartments of the drum so that the jaws 57 mesh with the compartments. Provision is made to ensure that the jaws 57 are opened as they pass around the roller 59, so that the article plus inserts is introduced into an opened jaw, as may be seen at 60.

The jaws 57 are then closed as shown at 61 so that the articles gripped thereby are lifted out of the compartments after passing over the top of the drum. The articles are conveyed in a suspended condition and can then be further processed, for example they can be laid out in an overlapped delivery, stacked etc.

As already mentioned, the above described apparatus is not limited to the insertion of inserts into articles. Independently thereof, or where appropriate in combination therewith, it is possible for numerous other operations to be performed, a few examples of which will now be described.

Figures 12A, 12B, 12C:
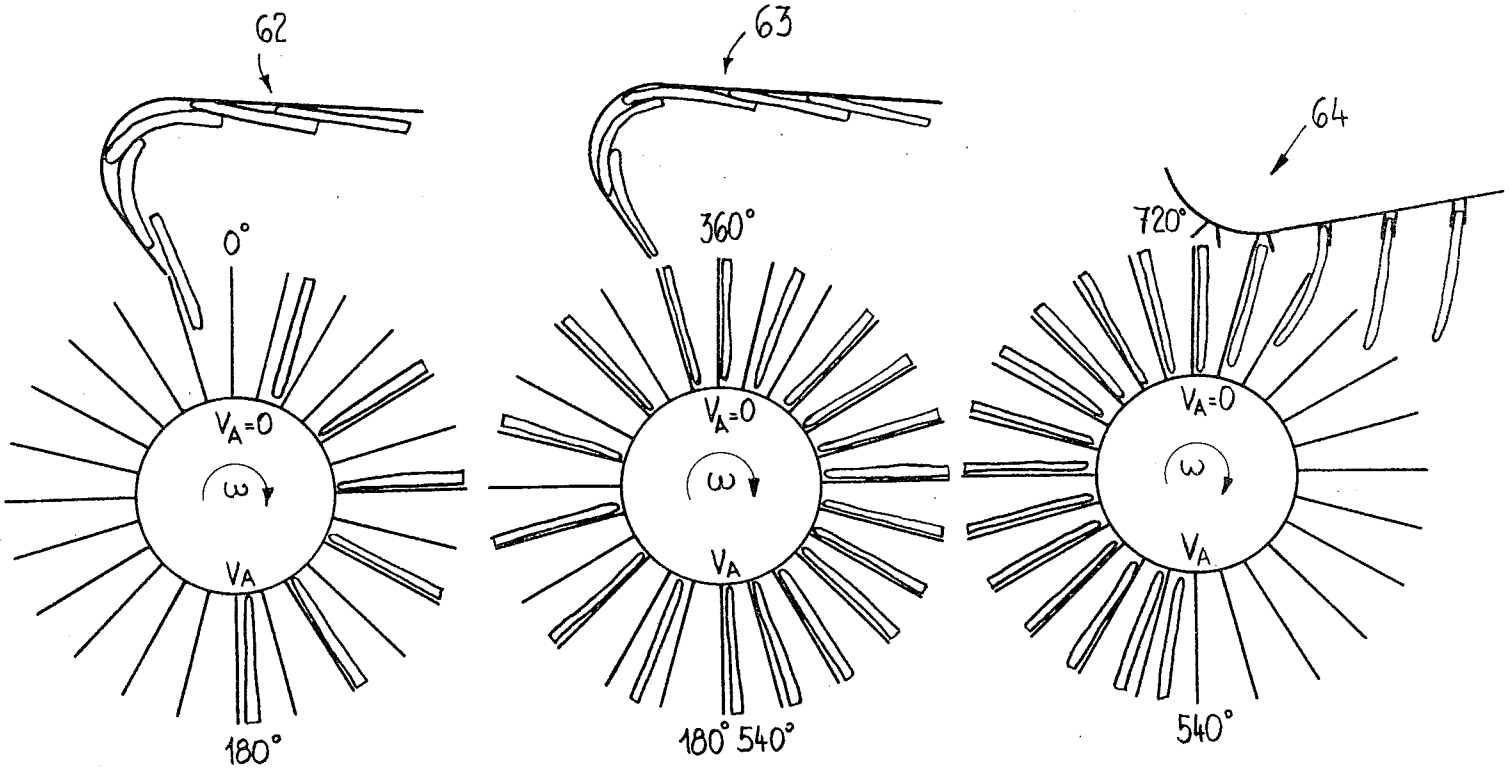
FIGS. 12*a* to *c* show diagrammatically (similar to FIGS. 6 to 9) separate views of adjacent units of handling apparatus for combining streams of overlapped articles.

According to FIG. 12 the apparatus is intended to combine two streams of overlapped material into a resultant overlapped stream. In FIG. 12*a* articles are supplied to the first compartment of the first unit of the drum by a conveyor 62, so that one article is inserted into only every other compartment. A similar procedure takes place by means of a further conveyor 63 (FIG. 12*b*) in an adjacent unit of the drum, and the articles in the first unit are moved axially into the empty compartments of the adjacent unit. The articles of two mixed streams are fed into the adjacent unit (FIG. 12*c*) by axial feed (designated by $V_A$), and are then removed by means of a conveyor 64 in a manner already described. As can be seen, the two streams of articles are fed in a staggered relationship rather like the teeth of a sliding clasp fastener. The articles delivered by the conveyor 64 can be laid out into a single overlapped stream. To explain the operation more clearly the rotational sections are indicated with or without axial feed ($V_A$) in FIGS. 12*a* to *c*.

It will be realized that the above-described embodiments may be used for performing a variety of operations. For example, the various sections of a journal or magazine may be assembled by supplying firstly the cover and then successively the sections as inserts, each of these being opened for the next insert. This procedure can be referred to as assembly from outside to inside. Sections can also be assembled adjacently in an opened cover, for example in bookmaking. Assembly may also take place from the inside to the outside, the innermost section being supplied to one end of the wheel and the successive further outwardly disposed sections being supplied subsequently.

Furthermore, the above-described operation could be reversed, i.e. for separating articles. A stream of articles supplied to the delivery unit would be moved axially to the adjacent unit, and only the articles in alternate compartments would be removed by a conveyor having jaws. The remaining articles would then be moved axially into the next adjacent unit and similarly removed.

Finally, it should be mentioned that cutting tools, folding tools and the like can be associated with the compartments in order to perform appropriate operations.

What is claimed is:

1. Apparatus for handling printed sheet products, comprising:

a drum;

means for rotatably driving said drum about a longitudinal axis;

means dividing said drum into a plurality of compartments extending radially of said axis;

means for supplying said products to the compartments at one location along said drum;

means individual to each of said compartments for axially advancing the products in said compartments in synchronism with the rotation of the drum from said one location to a second location along said drum; and means for removing said products from the compartments at said second location.

2. Apparatus according to claim 1, further comprising means within the compartments, intermediate ends of said drum, for manipulating said products as they advance.

3. Apparatus according to claim 2, wherein said products are folded and wherein said manipulating means within the compartments include axially-extending wedges for opening said folded products as they are advanced within the wedge-containing compartments.

4. Apparatus according to claim 3, further comprising spaced guide plates within each wedge-containing compartment, said plates being related to the wedges to retain the product in an opened condition within said compartments.

5. Apparatus according to claim 4, wherein each pair of said guide plates defines a slot and wherein said apparatus further includes means for introducing additional products to said drum within said slots.

6. Apparatus according to claim 2, wherein said products are folded and wherein said manipulating means within the compartments include axially spaced sets of axially-extending wedge-shaped members, said compartments having opposite side walls defining with said wedge-shaped members axially spaced and axially-extending feed ducts; radially extending walls connected to said wedge-shaped members and defining axially spaced sets of slots extending radially into said feed ducts; and a supply device associated with each axially spaced set of slots.

7. Apparatus according to claim 6, wherein each supply device comprises a conveyor; gripper jaws on said conveyor; and means for moving said conveyor substantially tangentially over said drum, the gripper jaws being arranged to align with said slots and to open for dropping products into said slots.

8. Apparatus according to claim 1, wherein said advancing means for each compartment comprises:

a plurality of rollers having longitudinal axes lying substantially in a plane which includes the longitudinal axis of said drum, and means for rotating said rollers during at least a portion of a rotation of said drum.

9. Apparatus according to claim 8, wherein said means for rotating the rollers comprises a stationary cam and means operatively related to said rollers for engaging said cam during rotation of the drum to impart rotation to the rollers.

10. Apparatus according to claim 9, wherein said drum includes a central core about which said compartments are located, said stationary cam being positioned within said core.

11. Apparatus according to claim 10, wherein said rollers include stub portions extending within the core so as to engage the cam during rotation of the drum to thereby impart rotation to the rollers.

12. Apparatus according to claim 8, wherein said advancing means for each compartment further includes:

means for thrusting a product within said compartment against said rollers during rotation of the rollers.

13. Apparatus according to claim 12, further comprising:

a cam; and follower means operatively associated with said thrusting means for engaging said cam during rotation of the drum to move said thrusting means from an inoperative position to an operative position wherein said thrusting means engages said product to thrust the product against the rollers.

14. Apparatus according to claim 1, wherein said axis is substantially horizontal and said products are supplied to the drum, and removed therefrom, at the periphery of the drum, the apparatus further comprising:

retaining means associated with said periphery for preventing products from falling out of said compartments during rotation of the drum.

15. Apparatus according to claim 14, wherein said retaining means comprises an endless belt positioned below said axis and covering a portion of the periphery of said drum as the drum rotates.

16. Apparatus according to claim 1, wherein the axis of said drum is substantially horizontally disposed and wherein said removing means comprises a conveyor extending tangentially away from the underside of said drum.

17. Apparatus according to claim 1, wherein said advancing means for each compartment comprises:

a stationary cam; and cam follower means mounted on said drum for rotation therewith and for driving said advancing means upon contact of said cam follower means with said stationary cam.

18. Apparatus according to claim 17, wherein said drum includes a central core; and said stationary cam is positioned within said core.

* * * * *